US010900191B2

(12) United States Patent
Hou et al.

(10) Patent No.: US 10,900,191 B2
(45) Date of Patent: Jan. 26, 2021

(54) PULLING-OUT DEVICE FOR PREFABRICATED CONCRETE SUPPORT WALL

(71) Applicant: SHANDONG UNIVERSITY, Shandong (CN)

(72) Inventors: Hetao Hou, Jinan (CN); Ning Wang, Jinan (CN); Bing Sun, Jinan (CN); Haiyang Li, Jinan (CN); Mingjun Li, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 0 days.

(21) Appl. No.: 16/489,615

(22) PCT Filed: Jun. 26, 2018

(86) PCT No.: PCT/CN2018/092744

§ 371 (c)(1),
(2) Date: Aug. 28, 2019

(87) PCT Pub. No.: WO2019/148751

PCT Pub. Date: Aug. 8, 2019

(65) Prior Publication Data

US 2020/0024818 A1 Jan. 23, 2020

(30) Foreign Application Priority Data

Feb. 5, 2018 (CN) ..... 2018 1 0113427
Feb. 5, 2018 (CN) ..... 2018 2 0192975 U

(51) Int. Cl.

| | |
|---|---|
| ***E02D 9/02*** | (2006.01) |
| ***E04G 21/14*** | (2006.01) |
| ***E04G 15/04*** | (2006.01) |

(52) U.S. Cl.
CPC ..... *E02D 9/02* (2013.01); *E04G 15/04* (2013.01); *E04G 21/142* (2013.01)

(58) Field of Classification Search
CPC ..... E02D 9/02; E02D 5/20; E04G 21/142; E04G 15/04

(Continued)

(56) References Cited

U.S. PATENT DOCUMENTS 718,066 A * 1/1903 McWilliams ..... E21B 31/20 294/86.25
1,062,534 A * 5/1913 Butler ..... F16B 13/065 411/55

(Continued)

FOREIGN PATENT DOCUMENTS

CN 205557512 U 9/2016
CN 107254876 A 10/2017

(Continued)

OTHER PUBLICATIONS

Oct. 18, 2018 Search Report issued in International Patent Application No. PCT/CN2018/092744.

(Continued)

*Primary Examiner* — Brent W Herring
(74) *Attorney, Agent, or Firm* — Oliff PLC

(57) ABSTRACT

A pulling-out device for a prefabricated concrete support wall, belonging to the field of concrete support structures, wherein a vertical hollow tube is pre-buried in the prefabricated concrete support wall. The pulling-out device includes a pulling-out mechanism disposed in the hollow tube by penetration, the lower end of the pulling-out mechanism is fixedly arranged in the prefabricated concrete support wall and positioned at the lower end of the hollow tube, a first fixing device for tensing the pulling-out mechanism is arranged at the upper end of the pulling-out mechanism, and (Continued)

the first fixing device is not connected with the prefabricated concrete support wall.

15 Claims, 7 Drawing Sheets

(58) Field of Classification Search
USPC ..... 52/122.1, 125.1, 125.2, 125.3, 125.4, 52/125.5, 125.6
See application file for complete search history.

(56) References Cited

U.S. PATENT DOCUMENTS 3,429,607 A * 2/1969 White ..... E04G 21/142 294/89
3,626,508 A * 12/1971 Sharrow ..... B66C 1/66 294/89
3,742,660 A * 7/1973 Bierweiler ..... E04B 1/34823 52/79.13
3,782,061 A * 1/1974 Minutoli ..... E04B 1/06 52/125.5
4,017,115 A * 4/1977 Holt ..... B66C 1/666 294/89
4,437,276 A * 3/1984 Goldberg ..... B28B 7/0008 52/125.5
5,212,920 A * 5/1993 Tye ..... E04G 21/142 52/127.1
5,649,782 A * 7/1997 Frohlich ..... B28B 23/005 403/10
6,568,730 B1 * 5/2003 Paterson ..... B66C 1/666 294/89
9,359,779 B2 * 6/2016 Borchardt ..... E04G 21/3295
10,060,145 B2 * 8/2018 Hansort ..... E04G 15/04
10,309,103 B2 * 6/2019 Recker ..... E04B 5/04
10,597,871 B2 * 3/2020 Recker ..... E04B 5/04
2003/0140575 A1 * 7/2003 Sanftleben ..... E04G 15/04 52/125.4
2010/0011678 A1 * 1/2010 Kelly ..... E04G 15/04 52/125.5
2011/0262263 A1 * 10/2011 Comerford ..... E04G 21/142 414/800
2019/0047828 A1 * 2/2019 Connell ..... E04G 21/142
2019/0048601 A1 * 2/2019 Jablonsky ..... E04G 21/142

FOREIGN PATENT DOCUMENTS

CN 206928296 U 1/2018
CN 108086319 A 5/2018
EP 19922 A1 * 12/1980
JP H03-271421 A 12/1991
JP H08-269966 A 10/1996

OTHER PUBLICATIONS

Oct. 18, 2018 Written Opinion of the International Searching Authority issued in International Patent Application No. PCT/CN2018/092744.

* cited by examiner

PULLING-OUT DEVICE FOR PREFABRICATED CONCRETE SUPPORT WALL

FIELD OF THE INVENTION

The present invention relates to the field of concrete support structures, in particular to a pulling-out device for a prefabricated concrete support wall.

BACKGROUND OF THE INVENTION

A foundation pit support structure is used to ensure the safety of the construction of an underground major structure and the environment surrounding the foundation pit. Temporary retaining, reinforcement, protection, underground water control and other measures taken for the foundation pit are often used for foundation pit protection, slope protection engineering and the like.

After use of the foundation pit support structure, the foundation pit support structure needs to be pulled out of the foundation pit for the next cycle. For the existing concrete support walls, when they are pulled out, a clamping head of a pile drawing machine is used for clamping the head of the concrete support wall, and simultaneously, a vibrating machine for vibrating is employed. As the amplitude of the vibrating machine is increased, a lifting hook is tensed so as to slowly lift the concrete support wall, and the vibrating machine stops until a hoist can directly lift the concrete support wall. By using this pulling-out way, the top of the concrete support wall is prone to being damaged under the action of repeated hammering and pulling-out. Furthermore, the concrete support wall is tensed as a whole during pulling out, so that the concrete has poor tensile performance and is prone to being damaged.

SUMMARY OF THE INVENTION

The technical problem to be solved in the present invention is to provide a pulling-out device for a prefabricated concrete support wall, which can effectively prevent concrete from being damaged when the concrete support wall is pulled out and thus prolong the service life of the concrete support wall.

In order to solve the above technical problems, the following technical solution for the present invention is provided.

A pulling-out device for a prefabricated concrete support wall is provided, a vertical hollow tube is pre-buried in the prefabricated concrete support wall, the pulling-out device includes a pulling-out mechanism disposed in the hollow tube by penetration, the lower end of the pulling-out mechanism is fixedly arranged in the prefabricated concrete support wall and positioned at the lower end of the hollow tube, a first fixing device for tensing the pulling-out mechanism is arranged at the upper end of the pulling-out mechanism, and the first fixing device is not connected with the prefabricated concrete support wall.

Further, the pulling-out mechanism is a first steel stranded wire, the first fixing device includes a lifting beam, a first steel stranded wire clamp and a first anchor plate arranged between the upper end surface of the lifting beam and the first steel stranded clamp, the upper end of the first steel stranded wire passes through the lifting beam and is fixed at the upper end of the lifting beam through the first steel stranded wire clamp, and the lifting beam contacts the upper end surface of the prefabricated concrete support wall under the action of the first steel stranded wire.

Further, a first U-shaped protecting plate is arranged at the lower end of the lifting beam, the prefabricated concrete support wall is clamped in a U-shaped slot of the first U-shaped protecting plate, and a through hole for enabling the first steel stranded wire to pass through is formed in the first U-shaped protecting plate.

Further, the side surfaces of the U-shaped slot of the first U-shaped protecting plate are arc-shaped surfaces, the center of a circle of each arc-shaped surface is positioned on the outer side of the first U-shaped protecting plate, and stiffening ribs are arranged on the outer sides of the first U-shaped protecting plate.

Further, the pulling-out mechanism is a second steel stranded wire, a groove is formed in the upper end of the prefabricated concrete support wall, a second U-shaped protecting plate is arranged in the groove, the first fixing device includes a rectangular steel and a second steel stranded wire clamp, which are arranged at the upper end surfaces of the second U-shaped protecting plate and positioned in the groove, the upper end of the rectangular steel is open, a lifting hole is formed in the side wall of the rectangular steel, the second steel stranded wire clamp is arranged in the rectangular steel, the upper end of the second steel stranded wire passes through the second U-shaped protecting plate and the rectangular steel and is fixed to the rectangular steel through the second steel stranded wire clamp, and the rectangular steel contacts the end surface of the groove under the action of the second steel stranded wire.

Further, a second fixing device for fixing the first steel stranded wire or the second steel stranded wire is pre-buried at the lower end of the hollow tube positioned in the prefabricated concrete support wall, the second fixing device includes a second anchor plate positioned at the lower end of the hollow tube, and a third steel stranded wire clamp is arranged below the second anchor plate.

Further, a protecting steel plate is arranged at the bottom end of the prefabricated concrete support wall, and the second fixing device is connected with the protecting steel plate by welding.

Further, the protecting steel plate is detachably connected at the bottom end of the prefabricated concrete support wall, stiffening ribs extending to the interior of the prefabricated concrete support wall are arranged on the inner side of the protecting steel plate or concrete extending to the interior of the prefabricated concrete support wall is poured on the inner side of the protecting steel plate.

Further, the pulling-out mechanism is a steel boom, an external thread is arranged at the upper end of the steel boom, the first fixing device includes a sleeve provided with an internal thread, the lower end of the sleeve is in threaded connection with the upper end of the steel boom, and the upper end of the sleeve is in threaded connection with a lifting ring.

Further, a reserved hole which is coaxial and communicated with the hollow tube is formed in the upper end surface of the prefabricated concrete support wall, and the diameter of the reserved hole is larger than that of the hollow tube.

Compared with the prior art, the present invention has the following beneficial effects: When the pulling-out device for the prefabricated concrete support wall of the present invention is used for manufacturing the prefabricated concrete support wall, by pre-burying the vertical hollow tube in the prefabricated concrete support wall, enabling the pulling-out mechanism to pass through the hollow tube and fixing the lower end of the pulling-out mechanism in the prefabricated concrete support wall, the upper end of the pulling-out mechanism can be placed freely in the hollow tube and extends to the upper part of the prefabricated concrete support wall. When the prefabricated concrete support wall needs to be pulled out after use, the upper end of the pulling-out mechanism is fixed to the first fixing device, then the first fixing device is fixed to a hoist or a crane, and then the hoist or the crane is started to lift the prefabricated concrete support wall.

In the process of lifting the prefabricated concrete support wall by the pulling-out device for the prefabricated concrete support wall of the present invention, as the first fixing device is only fixedly connected with the upper end of the pulling-out mechanism but not actually fixedly connected with the prefabricated concrete support wall, when the hoist or the crane drives the first fixing device to go up, the first fixing device drives the pulling-out mechanism to go up, the pulling-out mechanism applies a pressure from the bottom to the top to the prefabricated concrete support wall at the bottom of the prefabricated concrete support wall, so that the prefabricated concrete support wall is pressed as a whole during pulling out, the stress is reasonable, the compressive strength of the concrete can be fully utilized, therefore, the concrete is effectively prevented from being damaged, and the service life and the cycling ratio of the prefabricated concrete support wall are improved.

DETAILED DESCRIPTION OF THE INVENTION

Figure 1:
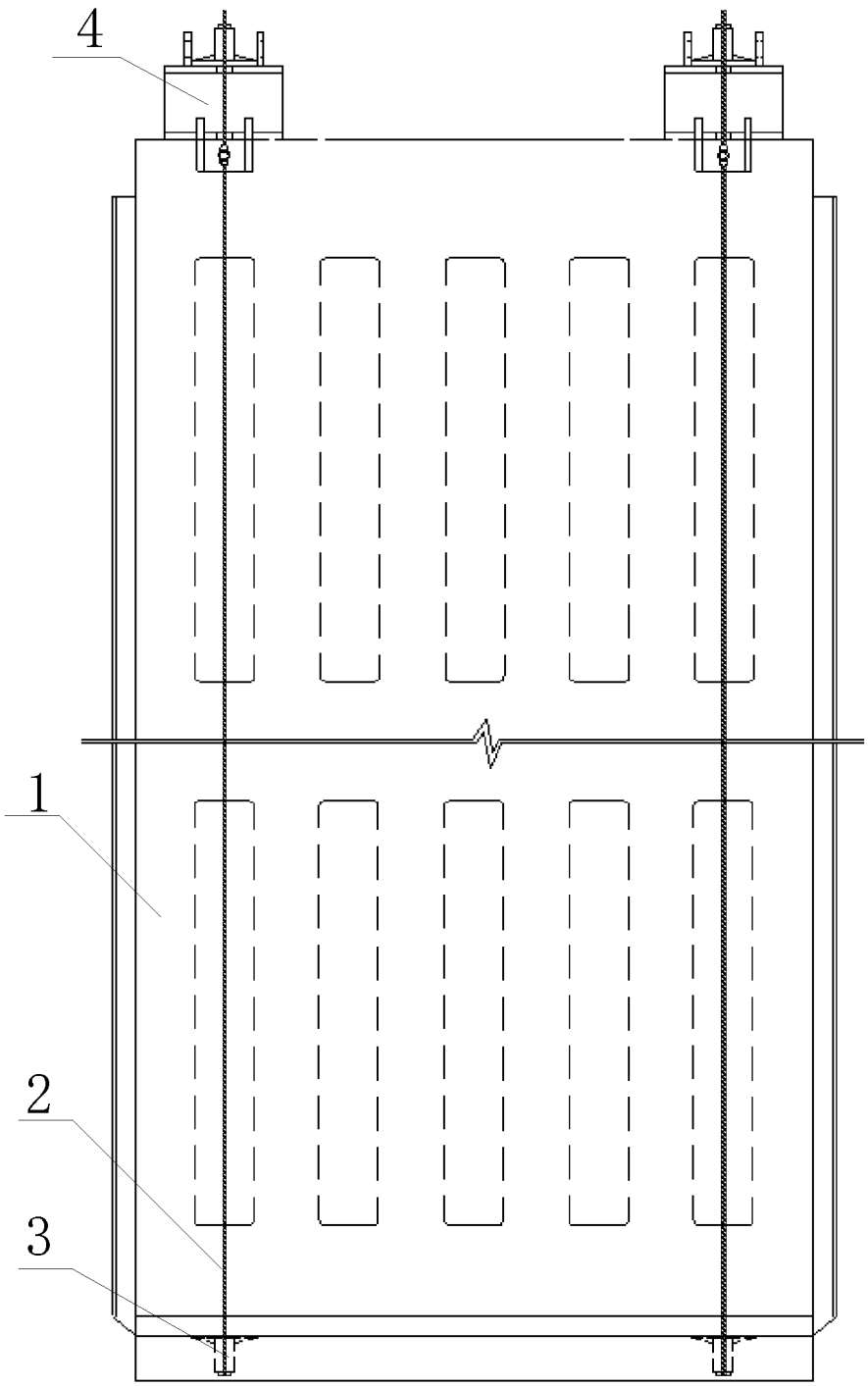
FIG. 1 is a front view of Embodiment 1 of a pulling-out device for a prefabricated concrete support wall of the present invention.

In order to enable the technical problems, technical solutions, and advantages of the present invention to be clearer, the present invention will be described below in detail in conjunction with the drawings and the specific embodiments.

The present invention provides a pulling-out device for a prefabricated concrete support wall, as shown in FIG. 1 to FIG. 14, a vertical hollow tube 1-1 is pre-buried in the prefabricated concrete support wall 1, the pulling-out device includes a pulling-out mechanism disposed in the hollow tube 1-1 by penetration, the lower end of the pulling-out mechanism is fixedly arranged in the prefabricated concrete support wall 1 and positioned at the lower end of the hollow tube 1-1, a first fixing device 4 for tensing the pulling-out mechanism is arranged at the upper end of the pulling-out mechanism, and the first fixing device is not connected with the prefabricated concrete support wall.

When the pulling-out device for the prefabricated concrete support wall of the present invention is used for manufacturing the prefabricated concrete support wall 1, by pre-burying the vertical hollow tube 1-1 in the prefabricated concrete support wall 1, passing the pulling-out mechanism through the hollow tube 1-1 and fixing the lower end of the pulling-out mechanism in the prefabricated concrete support wall 1, the upper end of the pulling-out mechanism can be placed freely in the hollow tube 1-1 and extends to the upper part of the prefabricated concrete support wall 1. When the prefabricated concrete support wall 1 needs to be pulled out after use, the upper end of the pulling-out mechanism is fixed to the first fixing device 4, then the first fixing device 4 is fixed to a hoist or a crane, and then the hoist or the crane is started to lift the prefabricated concrete support wall 1.

In the process of lifting the prefabricated concrete support wall 1 by the pulling-out device for the prefabricated concrete support wall of the present invention, as the first fixing device 4 is only fixedly connected with the upper end of the pulling-out mechanism and not actually fixedly connected with the prefabricated concrete support wall 1, when the hoist or the crane drives the first fixing device 4 to go up, the first fixing device 4 drives the pulling-out mechanism to go up, the pulling-out mechanism applies the pressure from the bottom to the top to the prefabricated concrete support wall 1 at the bottom of the prefabricated concrete support wall 1, so that the prefabricated concrete support wall 1 is pressed as a whole during pulling out, the stress is reasonable, the compressive strength of the concrete can be fully utilized, the concrete is effectively prevented from being damaged, and the service life and the cycling ratio of the prefabricated concrete support wall 1 are improved.

In the present invention, the pulling-out mechanism can adopt the structural form of the steel stranded wire or the steel boom, and several embodiments of the pulling-out are given as follows:

Embodiment 1

As shown in FIG. 1 to FIG. 4, a pulling-out mechanism can be a first steel stranded wire 2, a first fixing device 4 preferably includes a lifting beam 4-2 and a first steel stranded wire clamp 4-1, the upper end of the steel stranded wire 2 passes through the lifting beam 4-2 and is fixed at the upper end of the lifting beam 4-2 through the first steel stranded wire clamp 4-1, and the lifting beam 4-2 contacts the upper end surface of the prefabricated concrete support wall 1 under the action of the first steel stranded wire 2. According to this structure, by arranging the lifting beam 4-2 between the first steel stranded wire clamp 4-1 and the prefabricated concrete support wall 1, the lifting beam 4-2 contacts the upper end surface of the prefabricated concrete support wall 1, a hoist or a crane drives the first steel stranded wire 2 to go up through the lifting beam 4-2, thereby pulling the prefabricated concrete support wall 1 out of the bottom. Furthermore, the first steel stranded wire clamp 4-1 contacts the upper end surface of the prefabricated concrete support wall 1 through the lifting beam 4-2 and not in direct contact with the upper end surface of the prefabricated concrete support wall 1, thereby increasing the contact area between the first steel stranded wire clamp 4-1 and the prefabricated concrete support wall 1 and being capable of preventing the concrete at a lifting point from being partially damaged.

In the above Embodiment 1, in order to further prevent the lifting beam 4-2 at the lifting point from being partially damaged, a first anchor plate 4-4 can also be arranged between the upper end surface of the lifting beam 4-2 and the first steel stranded wire clamp 4-1 to increase the contact area between the first steel stranded wire clamp 4-1 and the lifting beam 4-2.

Figure 2:
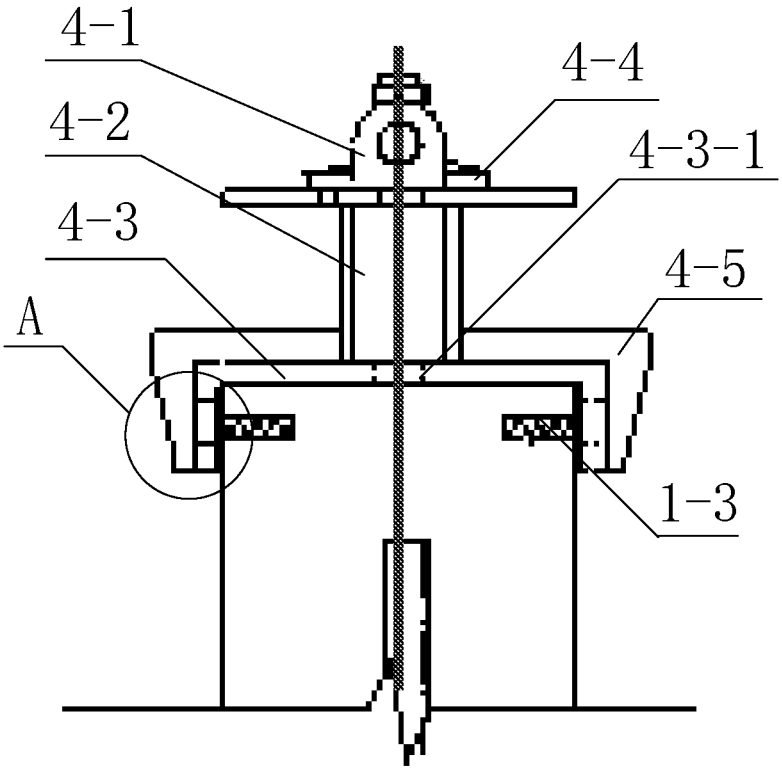
FIG. 2 is a front view of a first fixing device in Embodiment 1 of the pulling-out device for the prefabricated concrete support wall of the present invention.
Figure 3:
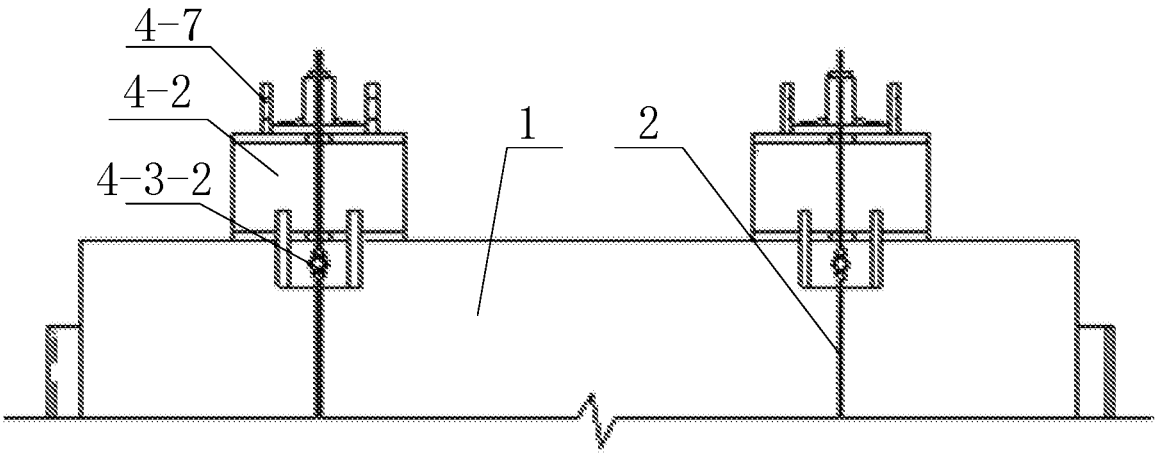
FIG. 3 is a side view of the first fixing device in Embodiment 1 of the pulling-out device for the prefabricated concrete support wall of the present invention.

In the above embodiment 1, in the process of pulling out the prefabricated concrete support wall 1, in order to prevent the lifting beam 4.2 from rotating relative to the prefabricated concrete support wall 1 and further affecting the pulling out of the prefabricated concrete support wall 1, a first U-shaped protecting plate 4-3 is preferably arranged at the lower end of the lifting beam 4-2, the prefabricated concrete support wall 1 is clamped in a U-shaped slot of the first U-shaped protecting plate 4-3, and a through hole 4-3-1 is formed in the first U-shaped protecting plate 4-3 for enabling the first steel stranded wire 2 to pass through. As shown in FIG. 2, the first U-shaped protecting plate 4-3 is clamped in the width direction of the prefabricated concrete support wall 1.

The first U-shaped protecting plate 4-3 can also be connected with the side surfaces of the prefabricated concrete support wall 1 by adopting bolts to further prevent the lifting beam 4-2 from rotating, wherein internal thread sleeves 1-3 for connecting with the bolts are pre-buried in the side surfaces of the prefabricated concrete support wall 1, a long circular hole 4-3-2 in the vertical direction is formed in the first U-shaped protecting plate 4-3, and the long circular hole is used for preventing the lifting beam 4-2 from being stressed during lifting.

In addition, lifting lugs 4-7 for lifting can also be welded on the lifting beam 4-2.

Figure 4:
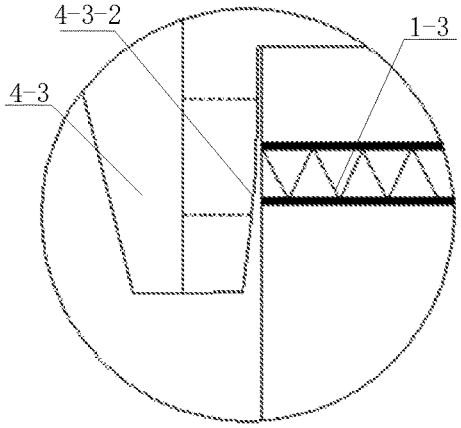
FIG. 4 is a partial enlarged schematic view of Part A in FIG. 2.

Preferably, in the above Embodiment 1, as shown in FIG. 4, the side surfaces of the U-shaped slot of the first U-shaped protecting plate 4-3 can be arc-shaped surfaces 4-3-2, the center of a circle of each arc-shaped surface is positioned on the outer side of the first U-shaped protecting plate 4-3, and stiffening ribs 4-6 for reinforcing the connection strength between the first U-shaped protecting plate 4-3 and the lifting beam 4-2 are arranged on the outer sides of the first U-shaped protecting plate 4-3. The side surfaces of the U-shaped slot of the first U-shaped protecting plate 4-3 are made into the arc-shaped surfaces, so that the prefabricated concrete support wall 1 can be prevented from causing damage to the concrete on the side surfaces of the prefabricated concrete support wall 1 during the pulling-out process.

Embodiment 2

Figure 5:
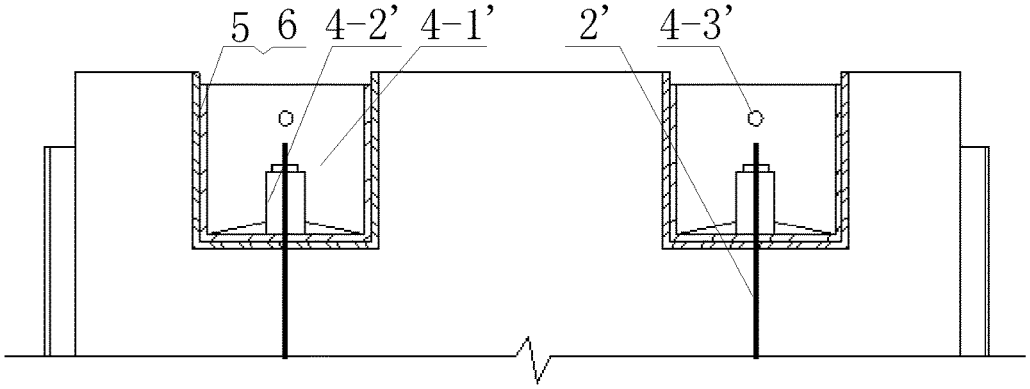
FIG. 5 is a partial front view of Embodiment 2 of the pulling-out device for the prefabricated concrete support wall of the present invention.
Figure 6:
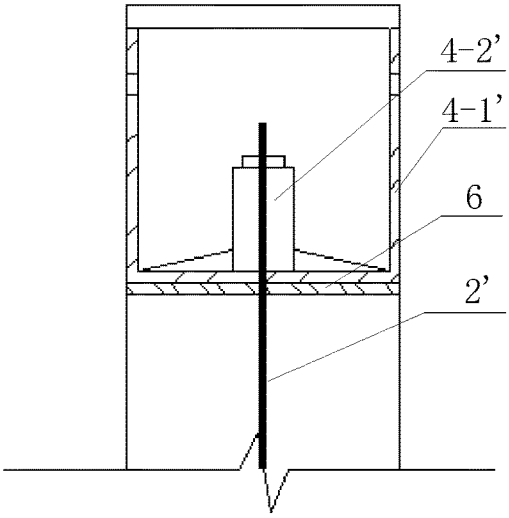
FIG. 6 is a partial side view of Embodiment 2 of the pulling-out device for the prefabricated concrete support wall of the present invention.

As shown in FIG. 5 and FIG. 6, the pulling-out mechanism can be a second steel stranded wire 2', a groove 5 is formed at the upper end of the prefabricated concrete support wall 1, a second U-shaped protecting plate 6 is arranged in the groove 5, the first fixing device 4 includes a first rectangular steel 4-1' and a second steel stranded wire clamp 4-2', which are arranged on the upper end surfaces of the second U-shaped protecting plate 6 and positioned in the groove 5, the upper end of the rectangular steel 4-1' is open, a lifting hole 4-3' is formed in the side wall of the first rectangular steel 4-1', the second steel stranded wire clamp 4-2' is arranged in the rectangular steel 4-1', the upper end of the second steel stranded wire 2' passes through the second U-shaped protecting plate 6 and the first rectangular steel 4-1' and is fixed to the first rectangular steel 4-1' through the second steel stranded wire clamp 2', and the first rectangular steel 4-1' contacts the end surfaces of the groove 5 under the action of the second steel stranded wire 2'. In the embodiment, the groove 5 is through long, and the second U-shaped protecting plate 2 can also be pre-buried in the position of the prefabricated concrete support wall 1 in the groove. When the prefabricated concrete support wall 1 is lifted, a steel pole passes through the lifting hole 4-3', a hoist or a crane is used for driving the first rectangular steel 4-1' to go up by lifting the steel pole, thereby pulling the prefabricated concrete support wall 1 out of the bottom. The top surface of the second U-shaped protecting plate 6 and the top surface of the rectangular steel 4-1' are lower than that of the prefabricated concrete support wall 1, so that the top surface of the second U-shaped protecting plate 6 and the rectangular steel 4 can be prevented from being damaged when the prefabricated concrete support wall 1 is installed and hammered.

Embodiment 3

Figure 7:
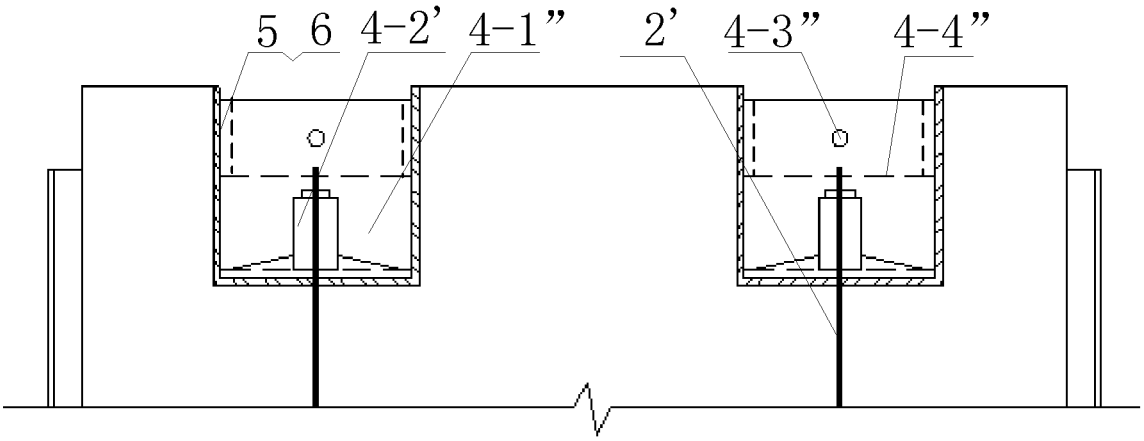
FIG. 7 is a partial front view of Embodiment 3 of the pulling-out device for the prefabricated concrete support wall of the present invention.
Figure 8:
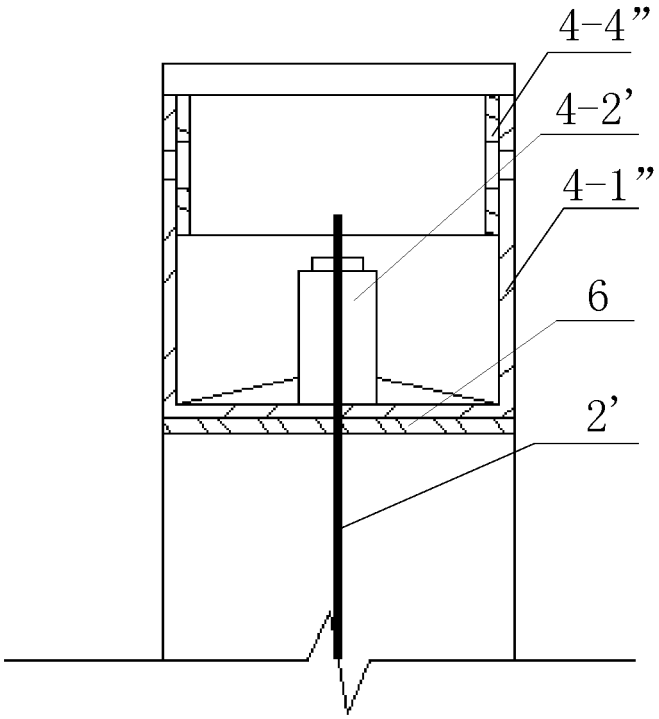
FIG. 8 is a partial side view of Embodiment 3 of the pulling-out device for the prefabricated concrete support wall of the present invention.

As shown in FIG. 7 and FIG. 8, the first fixing device 4 adopts a U-shaped steel plate 4-1" to replace the first rectangular steel 4-1' in Embodiment 2, and other structures are the same with those in Embodiment 2. In addition, in order to reduce the deformation of the U-shaped steel plate 4-1" during lifting, a steel plate or a second rectangular steel 4-4" can be detachably connected in the position corresponding to the lifting hole 4-3" on the inner side wall of the U-shaped steel plate 4-1".

Embodiment 4

Figure 9:
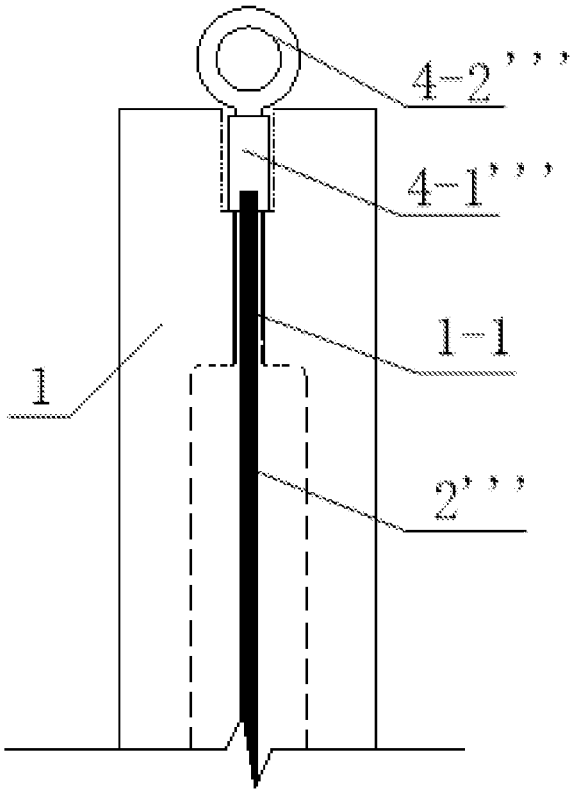
FIG. 9 is a partial side view of the upper part of Embodiment 3 of the pulling-out device for the prefabricated concrete support wall of the present invention.
Figure 10:
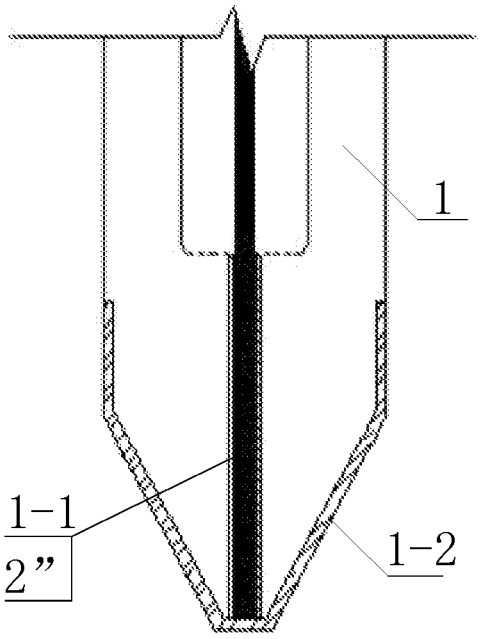
FIG. 10 is a partial side view of the lower part of Embodiment 3 of the pulling-out device for the prefabricated concrete support wall of the present invention.

As shown in FIG. 9 and FIG. 10, the pulling-out mechanism can be a steel boom 2''', an external thread is arranged at the upper end of the steel boom 2''', the first fixing device 4 includes a sleeve 4-1''' provided with an internal thread, the lower end of the sleeve 4-1''' is in threaded connection with the upper end of the steel boom 2''' or the steel boom 2''' is directly welded with the sleeve 4-1''', and the upper end of the sleeve 4-1''' is in threaded connection with a lifting ring 4-2'''. The sleeve 4-1''' is directly connected to the steel boom 2''' by threaded connection and is not in connection or contact with the prefabricated concrete support wall 1, and when the prefabricated concrete support wall 1 is lifted by the hoist or the crane, the lifting ring 4-2''' is connected to the hoist or the crane to drive the steel boom 2''' to go up, thereby pulling the prefabricated concrete support wall 1 out of the bottom.

In the above Embodiment 1 and Embodiment 2, in order to reinforce the connection strength between the first steel stranded wire 2 or the second steel stranded wire 2' and the prefabricated concrete support wall 1, a second fixing device 3 for fixing the first steel stranded wire 2 or the second steel stranded wire 2' is preferably pre-buried at the lower end of the hollow tube 1-1 positioned in the prefabricated concrete support wall 1, the second fixing device 3 includes a second anchor plate 3-1 positioned at the lower end of the hollow tube 1-1, and a third steel stranded wire clamp 3-2 is arranged below the second anchor plate 3-1.

In addition to adopting the above structure as the second fixing device 3, those skilled in the art can select other steel stranded wire end fixing devices meeting the above principles, for example, a lifting ring is pre-buried in the prefabricated concrete support wall 1, and the lower end of the first steel stranded wire 2 or the second steel stranded wire 2' is fixed to the lifting ring, while the implementation of the technical scheme of the present invention will not be affected.

Figure 11:
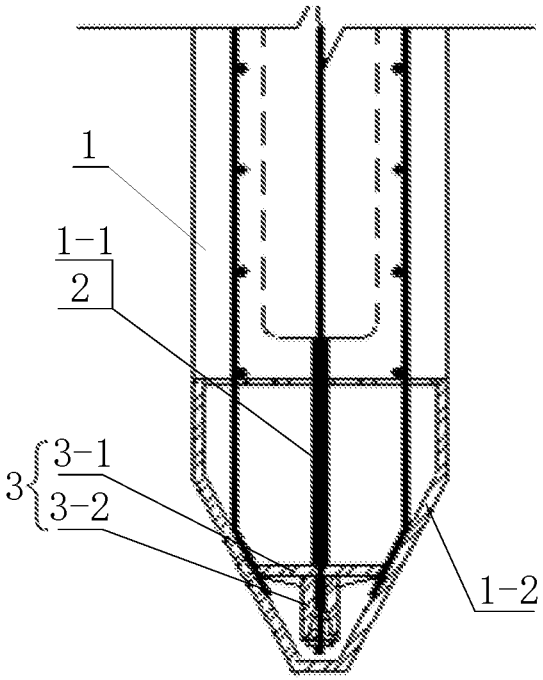
FIG. 11 is a structural schematic view of a second fixing device in Embodiment 1 and Embodiment 2 of the pulling-out device for the prefabricated concrete support wall of the present invention.

In the above Embodiments 1-4, a protecting steel plate 1-2 is preferably arranged at the bottom end of the prefabricated concrete support wall 1, wherein, in Embodiments 1 and 2, as shown in FIG. 11, the second fixing device 3 is connected with the protecting steel plate 1-2 by welding. In Embodiment 3, as shown in FIG. 10, the steel boom 2" is connected with the protecting steel plate 1-2 by welding. The protecting steel plate 1-2 can not only prevent the prefabricated concrete support wall 1 from being damaged when being installed into a foundation pit or being pulled out of the foundation pit, but also reduce the frictional resistance to the prefabricated concrete support wall 1 when the prefabricated concrete support wall 1 goes into and out of the soil and increase partial compressive strength of concrete. Furthermore, the second fixing device 3 is connected with the protecting steel plate 1-2 by welding, thereby further increasing the fixing strength of the second fixation device 3 at the bottom of the prefabricated concrete support wall 1.

Figure 12:
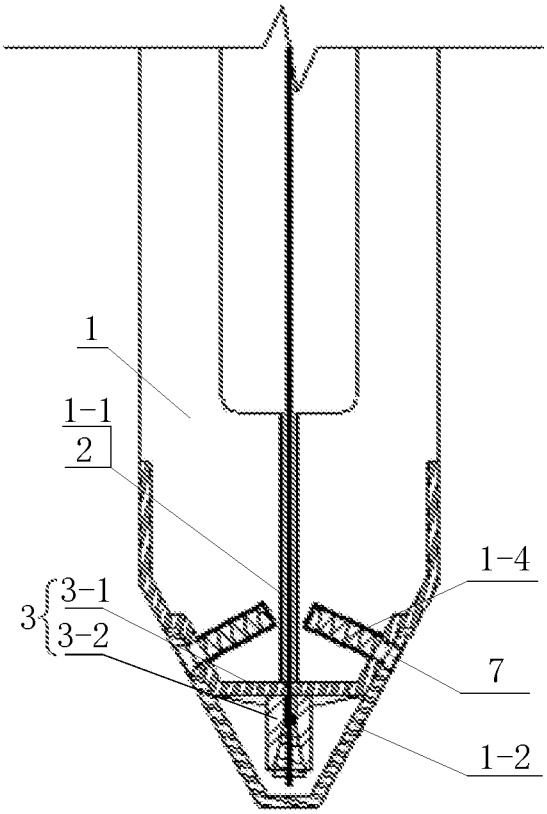
FIG. 12 is a structural schematic view of a detachable protecting steel plate in Embodiment 1 and Embodiment 2 of the pulling-out device for the prefabricated concrete support wall of the present invention.

As an improvement of the above Embodiments 1-3, the protecting steel plate 1-2 is preferably detachably connected at the bottom end of the prefabricated concrete support wall 1. As shown in FIG. 12, the protecting steel plate 1-2 is fixed on the outer side of the prefabricated concrete support wall 1 through a countersunk head screw 7, and a groove is formed in the position for mounting the countersunk head screw 5 on the protecting steel plate 1-2, such that the countersunk head screw 7 is flush with the surface of the protecting steel plate 1-2 after being screwed into an internal thread sleeve 1-4 of the prefabricated concrete support wall 1. By designing the protecting steel plate 1-2 as a detachable structure, the steel stranded wire with serious abrasion at the top end due to repeated anchoring can be replaced by a new steel stranded wire. The replacement way is as follows: the protecting steel plate 1-2 is firstly detached, then the first steel stranded wire clamp 3-2 is disassembled to fix one end of the new steel stranded wire and the lower end of the original steel stranded wire together, then the old steel stranded wire is pulled out of the upper end of the prefabricated concrete support wall 1, the new steel stranded wire is simultaneously drawn into place, the new steel stranded wire is cut off after being in place, then the bottom end of the new steel stranded wire is anchored by the first steel stranded wire clamp 3-2, and the protecting steel plate 1-2 is finally fixed on the prefabricated concrete support wall 1 by the countersunk head screw 7 to complete the replacement.

The protecting steel plate 1-2 mainly relies on extrusion and friction with the prefabricated concrete support wall 1 and anti-shearing capacity of the countersunk head screw 7 when the prefabricated concrete support wall 1 is hammered into the soil, and stiffening ribs can be arranged in the protecting steel plate 1-2 or the concrete is filled in the protecting steel plate 1-2 to prevent damage to the protecting steel plate.

The protecting steel plate 1-2 can be divided into two parts, wherein a detachable part is only arranged in the position corresponding to the first steel stranded wire clamp 3-2 on the prefabricated concrete support wall 1, an undetachable part is positioned in another position at the bottom of the prefabricated concrete support wall 1, and a rabbet is arranged at the joint of the detachable part and the undetachable part for flushing the surfaces of the two.

Figure 13:
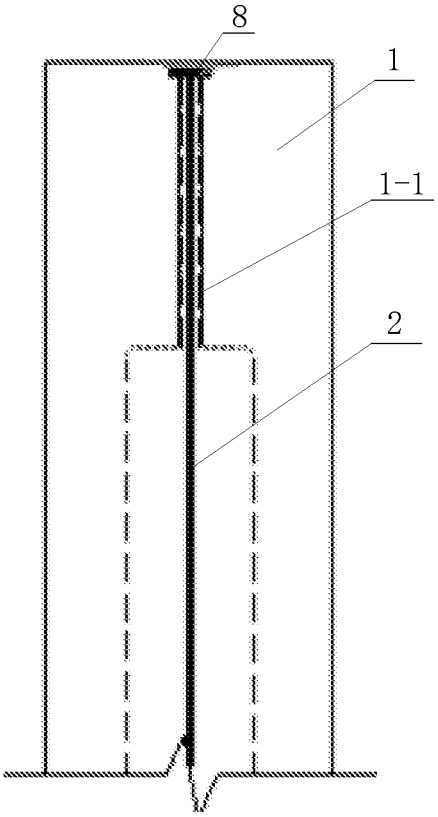
FIG. 13 is a structural schematic view of a reserved hole in Embodiment 1 and Embodiment 4 of the pulling-out device for the prefabricated concrete support wall of the present invention.

Further, in the above Embodiments 1 and 4, as shown in FIG. 13, a reserved hole 1-5 which is coaxial and communicated with the hollow tube 1-1 is formed in the upper end surface of the prefabricated concrete support wall 1, and the diameter of the reserved hole 1-5 is larger than that of the hollow tube 1-1.

Figure 14:
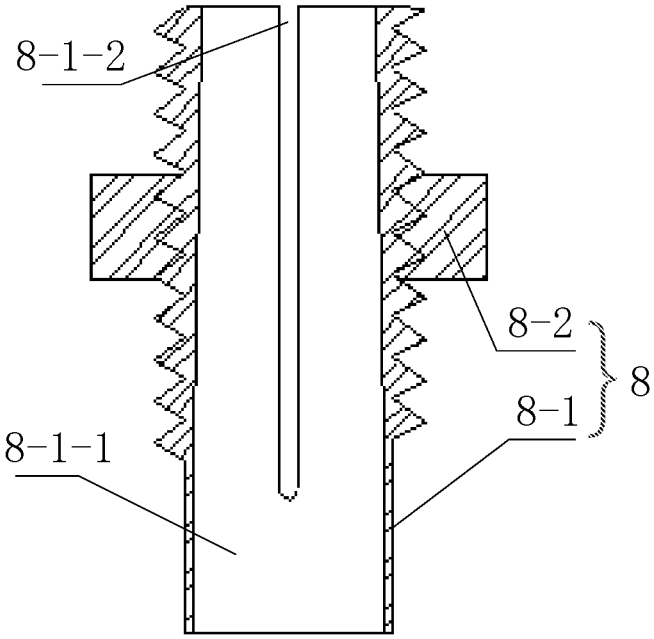
FIG. 14 is a structural schematic view of an end socket in Embodiment 1 of the pulling-out device for the prefabricated concrete support wall of the present invention.

In Embodiment 1, in order to prevent the first steel stranded wire 2 from retracting into the hollow tube 1-1 during the use of the prefabricated concrete support wall 1, an end socket 8 can be arranged at the top end of the first steel stranded wire 2, and the end socket 8 is placed in the reserved hole 1-5. When the prefabricated concrete support wall 1 is pulled out by the first steel stranded wire 2, after the steel stranded wire 2 is pulled out through the end socket 8, the end socket 8 can be detached from the steel stranded wire 2 and the steel stranded wire 2 can be fixed to the second steel stranded wire clamp 4-1. As shown in FIG. 14, the end socket 8 can be composed of two parts, namely a sleeve 8-1 and a nut 8-2, and the inner diameter of the sleeve 8-1 is gradually reduced from the bottom to the top. When the end socket 8 is used, the first steel stranded wire 2 passes through the inner diameter of the sleeve 8-1, then the nut 8-2 is screwed up, and then the first steel stranded wire 2 can be clamped by the upper part of the sleeve 8-1. In addition, threads or grooves can be arranged on the inner sides of the upper part of the sleeve 8-1 for further clamping the first steel stranded wire 2.

In Embodiment 3, the lower end of the sleeve 4-1" can extend into the reserved hole 1-5 to be in threaded connection with the steel boom 2", and the upper end of the sleeve 4-1" extends out of the reserved hole 1-5 to be in threaded connection with the lifting ring 4-2", so that the lifting ring 4-2" is positioned above the prefabricated concrete support wall 1 to facilitate the connection between the lifting ring 4-2" and the hoist or the crane.

It should be noted that, in the present invention, the first steel stranded wire clamp 4-1, the second steel stranded wire clamp 4-2" and the third steel stranded wire clamp 3-2 can adopt special clamps for fixing the steel stranded wires in the prior art, and the lifting beam 4-2 can be designed according to actual needs.

In the process of pulling out the prefabricated concrete support wall 1, as the upper ends of the first steel stranded wire 2, the second steel stranded wire 2' and the steel boom 2" can swing back and forth, in order to prevent the first steel stranded wire 2, the second steel stranded wire 2' and the steel boom 2" from causing partial damage to the prefabricated concrete support wall 1 by repeated scratch and collision with the concrete, the hollow tube 1-1 pre-buried in the upper part of the prefabricated concrete support wall 1 is a steel tube preferably, and the hollow tube 1-1 pre-buried in another position of the prefabricated concrete support wall 1 can be a plastic tube made of PVC and the like. In addition, a lubricating agent can also be smeared on the surface of the steel stranded wire 2 to reduce the friction between one of the first steel stranded wire 2, the second steel stranded wire 2' and the steel boom 2" and the hollow tube 1-1.

The above embodiments are preferred embodiments of the present invention. It should be noted that, those skilled in the art can also make a number of improvements and modifications without departing from the principles of the present invention, and the improvements and modifications should also be regarded as being within the protection scope of the present invention.

The invention claimed is:

1. A pulling-out device for a prefabricated concrete support wall, a vertical hollow tube being pre-buried in the prefabricated concrete support wall, the pulling-out device comprising:

a pulling-out mechanism that is a steel stranded wire and is disposed in the hollow tube by penetration, a lower end of the pulling-out mechanism being fixedly arranged in the prefabricated concrete support wall and positioned at a lower end of the hollow tube;

a first fixing device for tensing the pulling-out mechanism and arranged at an upper end of the pulling-out mechanism, the first fixing device not being connected with the prefabricated concrete support wall and comprising (i) a lifting beam, (ii) a first steel stranded wire clamp, and (iii) a first anchor plate arranged between an upper end surface of the lifting beam and the first steel stranded wire clamp, wherein:

an upper end of the steel stranded wire passes through the lifting beam and is fixed at an upper end of the lifting beam through the first steel stranded wire clamp, the lifting beam contacts an upper end surface of the prefabricated concrete support wall under action of the steel stranded wire, a U-shaped protecting plate is arranged at a lower end of the lifting beam, the prefabricated concrete support wall is clamped in a U-shaped slot of the U-shaped protecting plate, and a through hole for enabling the steel stranded wire to pass through is formed in the U-shaped protecting plate.

2. The pulling-out device for the prefabricated concrete support wall according to claim 1, wherein:

side surfaces of the U-shaped slot of the U shaped protecting plate are arc-shaped surfaces, a center of a circle of each arc-shaped surface is positioned on at least one outer side of outer sides of the U shaped protecting plate, and stiffeners are arranged on the outer sides of the U shaped protecting plate.

3. The pulling-out device for the prefabricated concrete support wall according to claim 2, wherein:

a second fixing device for fixing the steel stranded wire is pre-buried at the lower end of the hollow tube positioned in the prefabricated concrete support wall, the second fixing device comprises a second anchor plate positioned at the lower end of the hollow tube, and a second steel stranded wire clamp is arranged below the second anchor plate.

4. The pulling-out device for the prefabricated concrete support wall according to claim 3, wherein:

a protecting steel plate is arranged at a bottom end of the prefabricated concrete support wall, and the second fixing device is connected with the protecting steel plate by welding.

5. The pulling-out device for the prefabricated concrete support wall according to claim 4, wherein:

the protecting steel plate is detachably connected at the bottom end of the prefabricated concrete support wall, and stiffeners extending to an interior of the prefabricated concrete support wall are arranged on an inner side of the protecting steel plate or concrete extending to the interior of the prefabricated concrete support wall is poured on the inner side of the protecting steel plate.

6. The pulling-out device for the prefabricated concrete support wall according to claim 1, wherein:

a second fixing device for fixing the steel stranded wire is pre-buried at the lower end of the hollow tube positioned in the prefabricated concrete support wall, the second fixing device comprises a second anchor plate positioned at the lower end of the hollow tube, and a second steel stranded wire clamp is arranged below the second anchor plate.

7. The pulling-out device for the prefabricated concrete support wall according to claim 6, wherein:

a protecting steel plate is arranged at a bottom end of the prefabricated concrete support wall, and the second fixing device is connected with the protecting steel plate by welding.

8. The pulling-out device for the prefabricated concrete support wall according to claim 7, wherein:

the protecting steel plate is detachably connected at the bottom end of the prefabricated concrete support wall, and stiffeners extending to an interior of the prefabricated concrete support wall are arranged on an inner side of the protecting steel plate or concrete extending to the interior of the prefabricated concrete support wall is poured on the inner side of the protecting steel plate.

9. The pulling-out device for the prefabricated concrete support wall according to claim 1, wherein a reserved hole which is coaxial with and communicates with the hollow tube is formed in the upper end surface of the prefabricated concrete support wall, and a diameter of the reserved hole is larger than that of the hollow tube.

10. A pulling-out device for a prefabricated concrete support wall, a vertical hollow tube being pre-buried in the prefabricated concrete support wall, the pulling-out device comprising:

a pulling-out mechanism that is a steel stranded wire and is disposed in the hollow tube by penetration, a lower end of the pulling-out mechanism being fixedly arranged in the prefabricated concrete support wall and positioned at a lower end of the hollow tube;

a first fixing device for tensing the pulling-out mechanism and arranged at an upper end of the pulling-out mechanism, the first fixing device not being connected with the prefabricated concrete support wall, wherein:

a groove is formed in an upper end of the prefabricated concrete support wall, a U shaped protecting plate is arranged in the groove, the first fixing device comprises a rectangular steel and a first steel stranded wire clamp, which are arranged at upper end surfaces of the U shaped protecting plate and positioned in the groove, an upper end of the rectangular steel is open, a lifting hole being formed in a side surface of the rectangular steel, the first steel stranded wire clamp is arranged in the rectangular steel, an upper end of the steel stranded wire passes through the U shaped protecting plate and the rectangular steel and is fixed to the rectangular steel through the first steel stranded wire clamp, and the rectangular steel contacts an end surface of the groove under action of the steel stranded wire.

11. The pulling-out device for the prefabricated concrete support wall according to claim 10, wherein:

a second fixing device for fixing the steel stranded wire is pre-buried at the lower end of the hollow tube positioned in the prefabricated concrete support wall, the second fixing device comprises an anchor plate positioned at the lower end of the hollow tube, and a second steel stranded wire clamp is arranged below the anchor plate.

12. The pulling-out device for the prefabricated concrete support wall according to claim 11, wherein:

a protecting steel plate is arranged at a bottom end of the prefabricated concrete support wall, and the second fixing device is connected with the protecting steel plate by welding.

13. The pulling-out device for the prefabricated concrete support wall according to claim 12, wherein:

the protecting steel plate is detachably connected at the bottom end of the prefabricated concrete support wall, and stiffeners extending to an interior of the prefabricated concrete support wall are arranged on an inner side of the protecting steel plate or concrete extending to the interior of the prefabricated concrete support wall is poured on the inner side of the protecting steel plate.

14. The pulling-out device for the prefabricated concrete support wall according to claim 10, wherein a reserved hole which is coaxial with and communicates with the hollow tube is formed in the upper end surface of the prefabricated concrete support wall, and a diameter of the reserved hole is larger than that of the hollow tube.

15. A pulling-out device for a prefabricated concrete support wall, a vertical hollow tube being pre-buried in the prefabricated concrete support wall, the pulling-out device comprising:

a pulling-out mechanism that is a steel boom and is disposed in the hollow tube by penetration, a lower end of the pulling-out mechanism being fixedly arranged in the prefabricated concrete support wall and positioned at a lower end of the hollow tube, an external thread being arranged at an upper end of the steel boom;

a first fixing device for tensing the pulling-out mechanism and arranged at an upper end of the pulling-out mechanism, the first fixing device not being connected with the prefabricated concrete support wall and comprising a sleeve provided with an internal thread, wherein:

a lower end of the sleeve is in threaded connection with the upper end of the steel boom, an upper end of the sleeve is in threaded connection with a lifting ring, a reserved hole which is coaxial with and communicates with the hollow tube is formed in the upper end surface of the prefabricated concrete support wall, and a diameter of the reserved hole is larger than that of the hollow tube.

* * * * *